US005474052A

United States Patent [19]

Aquino et al.

[11] Patent Number: 5,474,052

[45] Date of Patent: Dec. 12, 1995

[54] AUTOMATED METHOD FOR COLD TRANSIENT FUEL COMPENSATION CALIBRATION

[75] Inventors: Charles F. Aquino, Ann Arbor; John E. Bradley, Detroit; Isis A. Messih, Troy, all of Mich.

[73] Assignee: Ford Motor Company, Dearborn, Mich.

[21] Appl. No.: 173,884

[22] Filed: Dec. 27, 1993

[51] Int. Cl.[6] ..... F02D 41/14

[52] U.S. Cl. ..... 123/675; 123/686; 123/492; 364/431.05; 364/431.12

[58] Field of Search ..... 123/674, 675, 123/686, 689, 480, 486, 488, 492, 493, 682; 364/431.05, 431.03, 431.04, 431.07, 431.12

[56] References Cited

U.S. PATENT DOCUMENTS

| | | | |
|---|---|---|---|
| 4,644,921 | 2/1987 | Kobayashi et al. | 123/689 |
| 4,999,781 | 3/1991 | Holl et al. | 123/674 |
| 5,021,959 | 6/1991 | Jundt et al. | 123/686 |
| 5,065,728 | 11/1991 | Nakaniwa | 123/689 |
| 5,239,974 | 8/1993 | Ebinger et al. | 123/675 |
| 5,265,581 | 11/1993 | Nagaishi | 123/675 |
| 5,271,374 | 12/1993 | Nagaishi et al. | 123/675 |

*Primary Examiner*—Willis R. Wolfe
*Attorney, Agent, or Firm*—Peter Abolins; Roger L. May

[57] ABSTRACT

An automated method for generating compensation values for use in an electronic engine controller during transient engine operation comprises an initial step of exposing an engine to an ambient temperature value to set the engine to an initial start temperature. The engine is started and operated in a predetermined manner until the engine reaches a stable operating temperature. The mass flow rate of air into an induction system of the engine is detected to generate a plurality of air flow values, the temperature of engine coolant is detected to generate a plurality of engine coolant temperature values and the composition of exhaust gas produced by the engine is detected to generate a plurality of exhaust gas values. The detected air flow values, engine coolant temperature values and exhaust gas values are stored in a data storage means. The engine is exposed to a plurality of ambient temperatures to generate data indicative of engine operation from a plurality of initial start temperatures. A first set of model values, indicative of a portion of fuel injected by the engine which directly impacts the induction system and a second set of model values indicative of a time constant corresponding to a rate at which fuel leaves the walls of the induction system are calculated as a function of the stored values. The compensation values are then generated as a function of the first and the second model values.

20 Claims, 6 Drawing Sheets

AUTOMATED METHOD FOR COLD TRANSIENT FUEL COMPENSATION CALIBRATION

FIELD OF THE INVENTION

This invention relates to automated methods for generating values for use by an electronic engine controller to control engine operating parameters and more specifically, to automated methods for generating compensation values for use in an electronic engine controller in compensating for fuel delay caused by induction system wetting effects experienced during engine warm-up.

BACKGROUND OF THE INVENTION

Fuel control systems are known for motor vehicle engines which compensate for fuel delay caused by slow fuel vaporization during cold engine operation by utilizing predetermined compensation values to alter the amount of fuel injected. The compensation values are stored in tables contained in an electronic engine controller which implements the fuel control system. As the engine warms up, different values are utilized to reflect the increased fuel vaporization rate. Such values are typically stored as a function of engine coolant temperature which correlates generally with the temperature of engine components contacted by fuel as it is injected and hence correlates generally with fuel vaporization rate. The compensation values can be obtained from a delay model which predicts the mass of fuel on the interior surface of the induction system of the engine for a particular engine coolant temperature and which also predicts a time constant indicative of a rate with respect to time at which fuel leaves the interior surfaces of the induction system for a particular engine coolant temperature. The delays result in a momentary lean air/fuel condition during acceleration and a momentary rich air/fuel condition during deceleration.

Known methods of generating the delay model involve an iterative trial-and-error process of generating a model, generating compensation values from the model, operating and monitoring the engine using the values, and subsequently altering the model or the values to cure observed deficiencies in engine operation. Such known methods are time consuming and may not result in an optimal fuel control strategy.

Accordingly, there exists a need for an improved method of generating compensation values for use by a fuel control system in compensating for fuel delay caused by slow fuel vaporization during cold engine operation.

SUMMARY OF THE INVENTION

It is an object of the present invention to generate compensation values for use in an electronic engine controller by a substantially automated method which provides accurate compensation values over a range of engine operation and which reduces the time required to generate the compensation values.

In accordance with the present invention the above object is achieved by exposing an engine to an ambient temperature to set the engine to an initial engine start temperature. The engine is then started and operated in a predetermined manner while the mass flow rate of air into an induction system of the engine is detected to generate a plurality of air flow values and engine coolant temperature is detected to generate a plurality of engine coolant temperature values. The composition of exhaust gas generated by the engine is monitored to generate a plurality of exhaust gas composition values. Each of the air flow values, engine coolant temperature values and exhaust gas composition values is stored in a data file. Data files are collected for a plurality of engine operations at a plurality of initial engine start temperatures, each data file containing air flow values, engine coolant temperature values and exhaust gas composition values corresponding to engine operation from a particular initial engine start temperature. A first set and a second set of model values are then generated as a function of the data contained in the plurality of data files. Each value of the first set of model values is indicative of a portion of fuel injected by the engine which directly impacts the interior surfaces of the induction system at a particular engine operating temperature and each value of the second set of model values is indicative of a time constant corresponding to a rate at which fuel leaves the interior surfaces of the induction system by vaporization or other means. The compensation values are then generated as a function of the first and the second set of model values.

An advantage of at least certain preferred embodiments is that compensation values for use by the electronic engine controller are generated by an automated method which substantially reduces or eliminates the need for time consuming and potentially inaccurate iterative trial and error techniques known in the art. An additional advantage is that the compensation values generated by certain preferred embodiments provide enhanced engine performance over a range of engine operating conditions.

These and other features and advantages of the invention will be better understood by considering the following detailed description of certain preferred embodiments. In the course of this description, reference will be made to the attached drawings.

DETAILED DESCRIPTION

Figure 1:
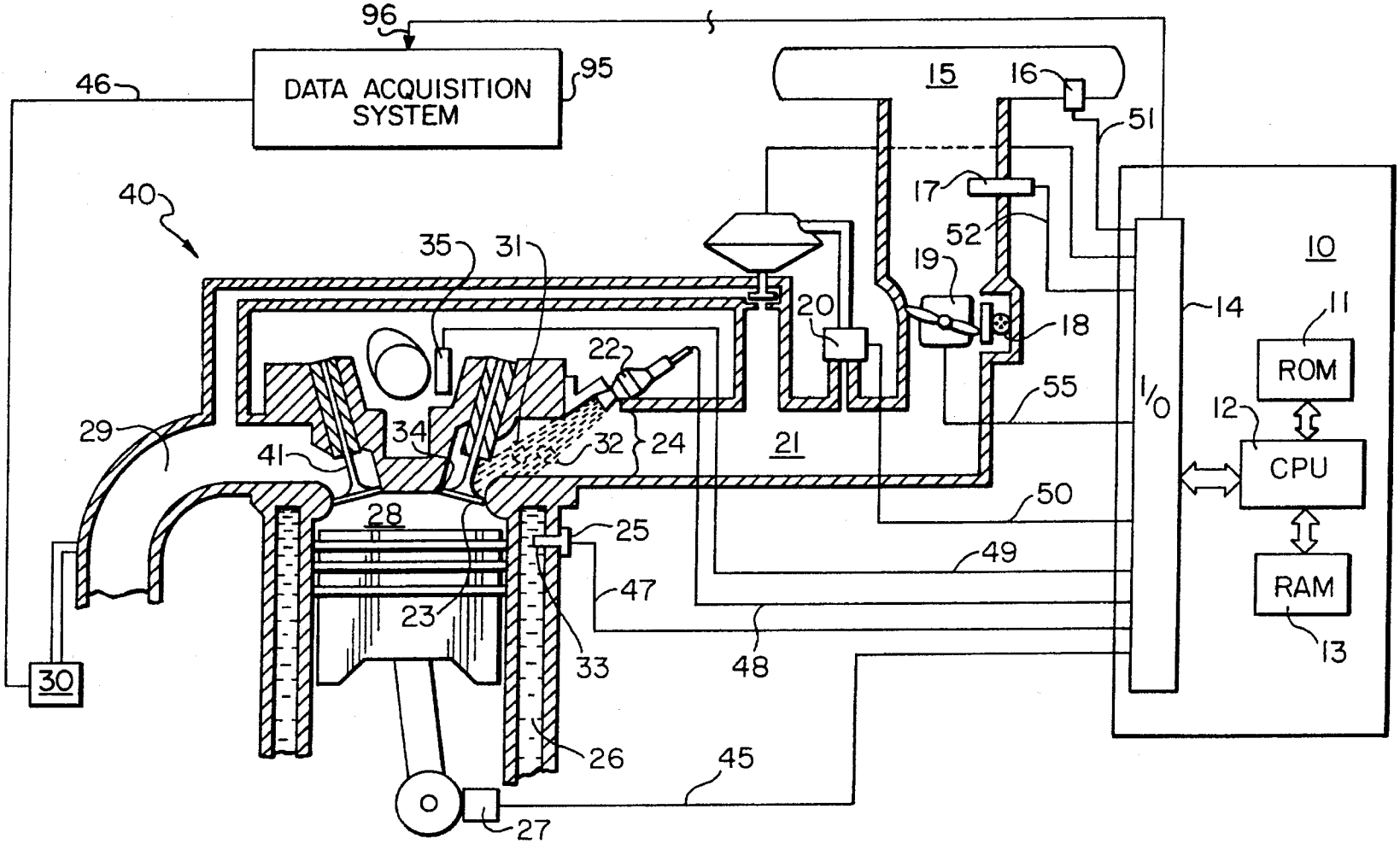
FIG. 1 is a schematic, partially cross-sectional illustration of an internal combustion engine, an electronic engine controller and an engine test and data acquisition system which embody the principles of the invention FIGS. 2(*a*) and 2(*b*) are flowcharts showing the operation of a preferred embodiment of the invention.

In FIG. 1 an internal combustion engine 40 comprising a plurality of cylinders, one cylinder of which is shown in FIG. 1, is controlled by an electronic engine controller (EEC) 10 which receives a plurality of signals from the engine, including an engine coolant temperature (ECT) signal 47 from an engine coolant temperature sensor 25 which is exposed to engine coolant circulating through coolant sleeve 26, a cylinder identification (CID) signal 49 from a CID sensor 35, a throttle position signal 55 generated by a throttle position sensor 19, a profile ignition pickup (PIP) signal 45 generated by a PIP sensor 27, an air intake temperature signal 51 from an air temperature sensor 16, and an air flow signal 52 from an air flow meter 17. The EEC 10 processes these signals received from the engine and generates a fuel injector signal transmitted to fuel injector 22 on signal line 48 to control the amount of fuel delivered by fuel injector 22. Intake valve 23 operates to open and close intake port 34 to control the entry of an air/fuel mixture into combustion chamber 28. A Universal Exhaust Gas Oxygen (UEGO) sensor 30 transmits information over signal line 46 directly to DAS 95.

Engine coolant circulating through coolant sleeve 26 operates to dissipate heat generated from the ignition of the air/fuel mixture in combustion chamber 28. Air drawn through air intake 15 passes by air temperature sensor 16, air flow meter 17 which senses the mass flow rate of air, throttle position sensor 19 and into induction system 21 which includes an intake port 34. A portion of the fuel from fuel injector 22, seen at 32, directly impacts the interior surfaces 24 of the induction system 21, the temperature of which is a function of the engine coolant temperature as sensed by coolant temperature sensor 25 and transmitted to the EEC 10 via signal line 47 and another portion of the fuel injected by injector 22, seen at 31, directly impacts the intake valve 23. Some of the fuel which directly impacts the interior surface 24 then is drawn into combustion chamber 28, while the remainder is left on the interior surfaces of the induction system as a film or residue.

Data Acquisition System (DAS) 95 receives data indicative of various operating parameters of engine 40 from the EEC 10 via bus 96 which comprises a plurality of data lines. Such a system is of known type and contains a microprocessor of known type along with random access memory for temporary data storage, read only memory for program storage, permanent data storage means such as one or more disk drives, human useable input means such as a keyboard for entry of commands and data and other input and output means for receiving signals from EEC 10 or sensors positioned on the engine and for transmitting and displaying information contained in the DAS. EEC 10 is appropriately programmed to transmit records of information comprising a plurality of fields at programmed intervals to DAS 95 over bus 96. Each of the fields contain particular engine operating information such as engine coolant temperature, air flow rate, and exhaust gas composition, as detected by appropriate sensors and transmitted to EEC 10.

A preferred embodiment of the present invention advantageously generates compensation values for use by the EEC 10 by exposing the engine to a plurality of initial ambient temperature values to set the engine to an initial start temperature which corresponds to each of the initial ambient temperature values. The engine is then started and operated a plurality of times in a predetermined manner for each of the initial start temperatures.

The mass flow rate of air into the induction system is detected to generate a plurality of air flow values. The air flow values are preferably indicative of the mass flow rate of air flowing into the induction system 21. The engine coolant temperature is detected to generate a plurality of engine coolant temperature values. The composition of exhaust gas produced by the engine is detected to generate a plurality of exhaust gas composition values during each of the plurality of engine operations. The exhaust gas composition values are preferably indicative of oxygen partial pressure in the exhaust gas produced by the engine; the oxygen partial pressure being indicative of the air/fuel ratio ignited by the engine to produce the detected exhaust gas value. The detected air flow values, engine coolant temperature values and exhaust gas composition values are stored in a data storage means contained in DAS 95. A first set of values which are indicative of a portion of fuel injected by the engine which directly impacts the induction system at the corresponding engine operating temperature are then generated, each of the values corresponding to a particular engine operating temperature. A second set of values which are indicative of a time constant corresponding to a rate at which fuel leaves the interior surfaces of the induction system at a particular engine operating temperature are also generated. Compensation values for use in EEC 10 are then generated as a function of the first and second set of values.

Figure 2A:
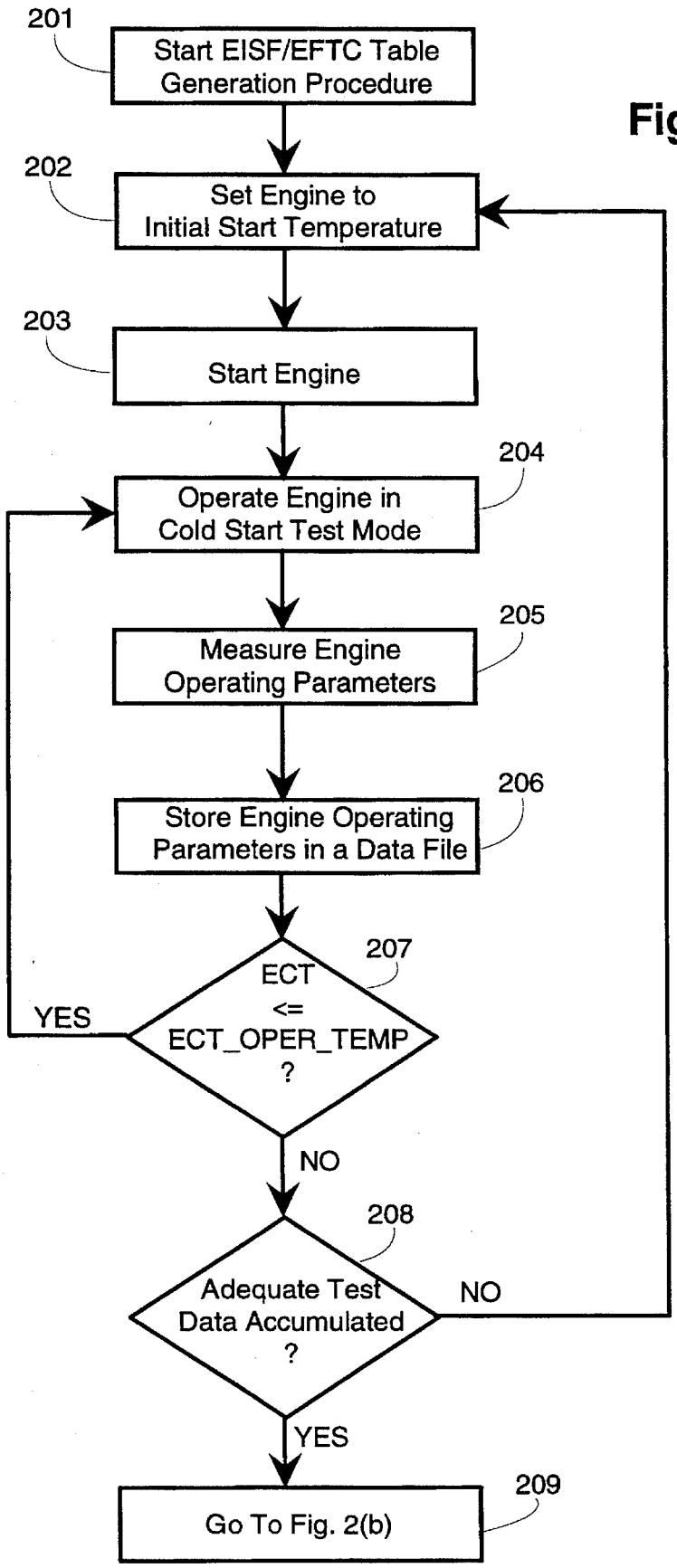
Figure 2B:
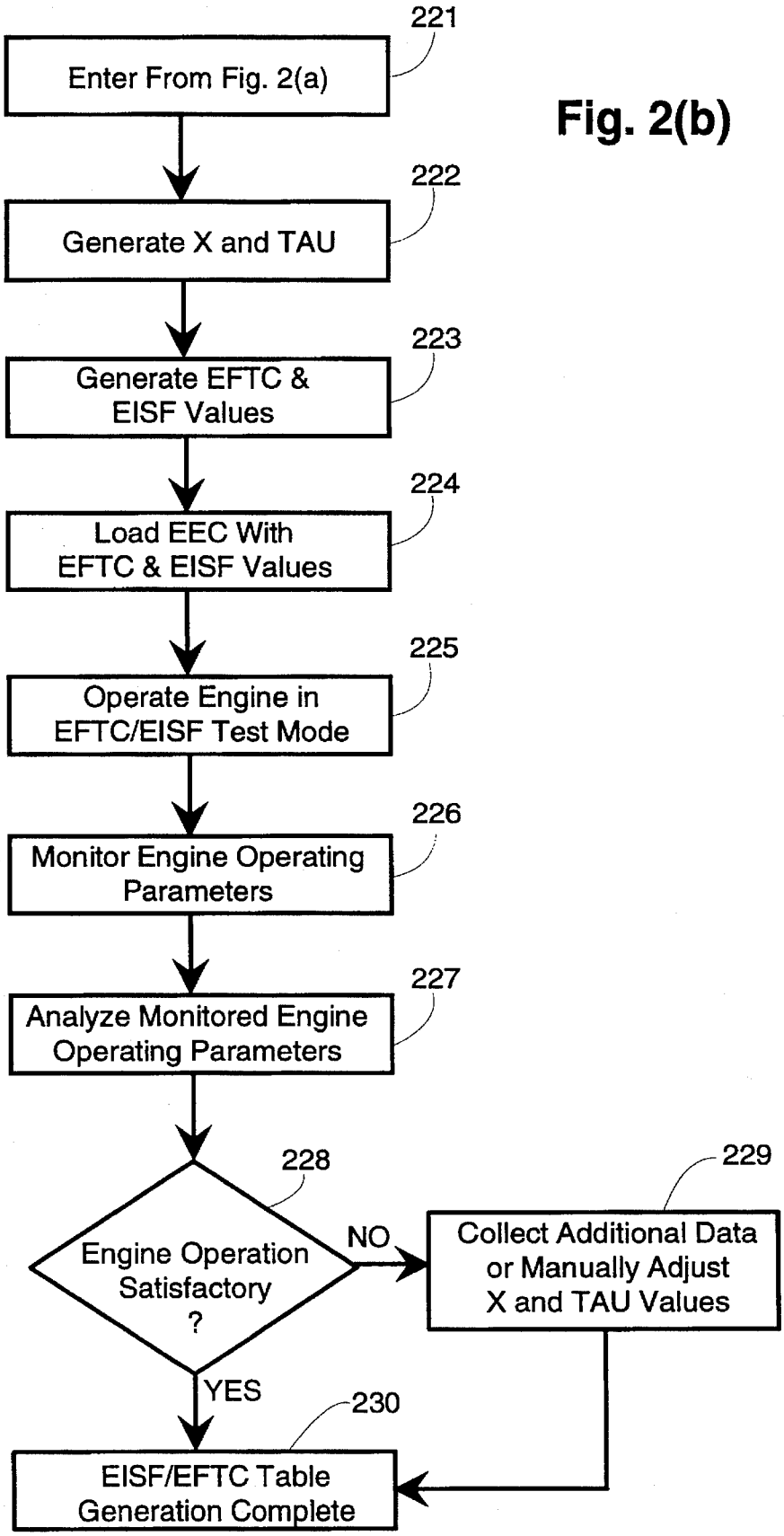

FIGS. 2(*a*) and 2(*b*) of the drawings are flowcharts showing the steps performed in a preferred embodiment to generate compensation values for two tables within EEC 10. A first table designated as an Equilibrium Intake Surface Fuel (EISF) table contains values each of which is indicative of the fuel mass residing on the interior surfaces of the induction system when the engine is operating under substantially steady state operation at a particular engine speed, load and operating temperature. In a preferred embodiment, the engine operating temperature is determined by measuring the temperature of the engine coolant 26 and load is determined as a function of engine speed and measured mass flow rate of air into the induction system. A second pair of tables designated as Effective fuel time constant (EFTC) tables contain values which are indicative of a time period over which a compensating mass of fuel is added or subtracted from a base fuel amount as generated by EEC 10 by known methods and are related to the rate of change of the fuel mass on the interior surfaces of the induction system while the engine is under a transient state. The transient state being characterized by the engine being under either acceleration or deceleration. Each of the values contained in a first EFTC table, herein termed EFTC compensation values, corresponding to an acceleration effective fuel time constant value for a particular engine operating temperature and engine load and each of the values contained in a second EFTC table corresponding to a deceleration effective fuel time constant value for a particular engine operating temperature and load.

The compensation values contained in the EISF and EFTC tables are used by EEC 10 in adjusting a base fuel value to compensate for fuel delay caused by slow fuel vaporization during cold engine operation. Each of the tables is indexed by engine load and engine coolant temperature. During engine operation, EEC 10 generates index values as a function of measured engine coolant temperature and engine load, retrieves a compensation value from each of the tables which corresponds to an empirically determined compensation value for the particular combination of engine coolant temperature and load, modifies the retrieved compensation value as a function of engine speed and utilizes the compensation values in adjusting base fuel value which is generated by a variety of known methods, including open-loop and closed-loop methods of control.

At 201 an EISF/EFTC Table Generation Procedure is entered, with the first step at 202 being to expose an engine to be calibrated to an ambient calibration temperature to bring the temperature of the engine to an initial engine start temperature. As will be appreciated by those skilled in the art, this procedure takes a certain amount of time to allow the engine components to reach the ambient calibration temperature. In one embodiment, the time required for the engine to achieve the initial start temperature is decreased by exposing the engine to an artificially low temperature which is lower than the initial start temperature. In an alternative embodiment the engine is exposed to normal surrounding temperature for a period of time adequate for the engine to cool to the initial start temperature.

At 203 the engine is started. In one embodiment, the engine is mounted in a manner similar to engines contained in production vehicles, and is started by turning the key in a manner similar to that in production vehicles. In an alternative embodiment, the engine is mounted on a conventional dynamometer and is started via controls on the dynamometer. At 204, 205, 206 and 207 the engine is operated in a cold start test mode and engine operating parameters are measured and stored in a data file in order to generate data indicative of engine operation during the cold start test mode from the initial start temperature. The data file is preferably stored within the data storage means contained within DAS 95 and comprises information stored for engine operation from a particular initial start temperature. The engine operating parameters measured and stored at steps 205 and 206 include engine coolant temperature, mass air flow rate through induction system 21 and the composition of exhaust gas produced by the engine 40 from ignition in combustion chamber 28 of an air/fuel mixture.

Figure 3:
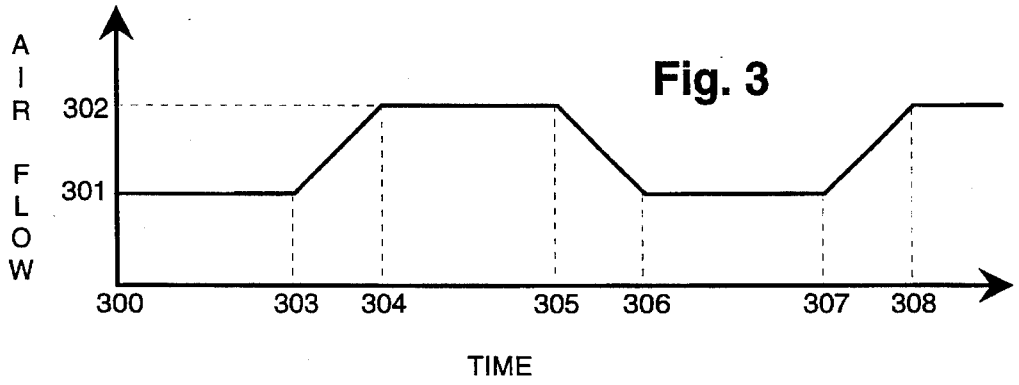
FIG. 3 is a graphical illustration of a mode of operation for a preferred embodiment of the invention.

Cold start test mode at step 204 operates in a manner shown in FIG. 3. A throttle controller of known type is attached to the engine to operate an engine throttle in a manner shown in FIG. 3. The throttle controller operates under control of DAS 95 which transmits signals to a throttle actuator within the throttle controller to control the throttle position. The cold start test mode is initiated at a first throttle position to allow a first air flow quantity 301, into induction system 21. The throttle is altered in a manner to minimize the impact of other phenomena which affect the generation of a base fuel value by EEC 10 and to isolate the effect of induction system fuel wetting on the delivery of fuel from the fuel injector to the combustion chamber. For example, manifold filling dynamics result in high frequency sources of metering error which must be accounted for by EEC 10 in generating a base fuel value. A preferred embodiment alters the throttle and maintains the throttle over an appropriate time period advantageously determined to minimize the impact of such manifold filling dynamics, and other possible sources of error, on the generation of the base fuel value, while maintaining the effect of fuel wall wetting dynamics.

The first throttle position is maintained for a first period of time from time point 300 to time point 303. At 303 the first throttle position is changed, over a second period of time, to a second throttle position to allow a second air flow quantity 302, into induction system 21. The second throttle position is maintained for a third period of time. At 305 the second throttle position is changed over a fourth period of time, from time point 305 to time point 306 to the first throttle position to allow the first air flow quantity 301 into induction system 21. The throttle operation shown from time points 300 to 306 is repeated until the engine coolant temperature has reached a temperature indicative of stable engine operating temperature. In a preferred embodiment the first time period is preferably eight seconds and the second time period is preferably one second.

In a certain embodiment the engine operating parameters, with the exception of exhaust gas composition, are measured as they would be on a production engine by the sensors shown in FIG. 1 and described above in the accompanying description. In an alternative embodiment, all of the operating parameters are measured by sensors placed on the engine as they would be on a production engine. Specifically, the UEGO sensor is replaced by a Heated Exhaust Gas Oxygen (HEGO) sensor which transmits information directly to EEC 10 as on a production engine. Like UEGO sensor 30 shown in FIG. 1, the HEGO sensor detects the composition of the exhaust gas by detecting the oxygen content of the exhaust gas and transmitting a representative signal.

At 207 the detected engine coolant temperature (ECT) is checked against a predetermined engine coolant temperature (ECT_OPER_TEMP) which is representative of the temperature of engine coolant when the engine has reached a stable operating temperature. If ECT is less than ECT_OPER_TEMP, meaning that the engine has not yet reached stable operating temperature, then steps 204–206 are repeated. If at 207 ECT is found to be greater than or equal to ECT_OPER_TEMP, then the engine is determined to be at a stable operating temperature and measurement and storage of engine operating parameters in the data file is concluded. In one embodiment, the determination shown at 207 is made by DAS 95 which stops storing data when the engine reaches stable operating temperature. In an alternative embodiment, the determination shown at 207 is made by a human operator who checks the engine coolant temperature and terminates the storage of engine operating parameters in the data file once the engine has reached a stable operating temperature.

At 208 a determination is made as to whether adequate test data has been stored to accurately generate data for the EISF and EFTC tables. Preferred embodiments of the present invention advantageously collect data indicative of engine operating parameters a plurality of times for a plurality of initial engine start temperatures. If adequate test data has not been accumulated then steps 202–208 are performed again to generate an additional set of data files. At 202 the initial start temperature may be equal to the prior initial start temperature if additional data is required for the prior initial start temperature. In a preferred embodiment, approximately six to seven data files are collected for each initial start temperature, and repeated for seven to eight different start temperatures to generate approximately fifty data files. This advantageously enhances the accuracy of the compensation values generated for the EISF and EFTC tables.

Once adequate test data has been accumulated, the steps shown in FIG. 2(*b*) are performed. At 222 the first model value X, which is indicative of a portion of fuel injected by the engine which directly impacts the induction system is generated. The second model value TAU, which is indicative of a time constant corresponding to a rate at which fuel leaves the interior surfaces of said induction system by vaporization or other means is also generated at 222.

Figure 5:
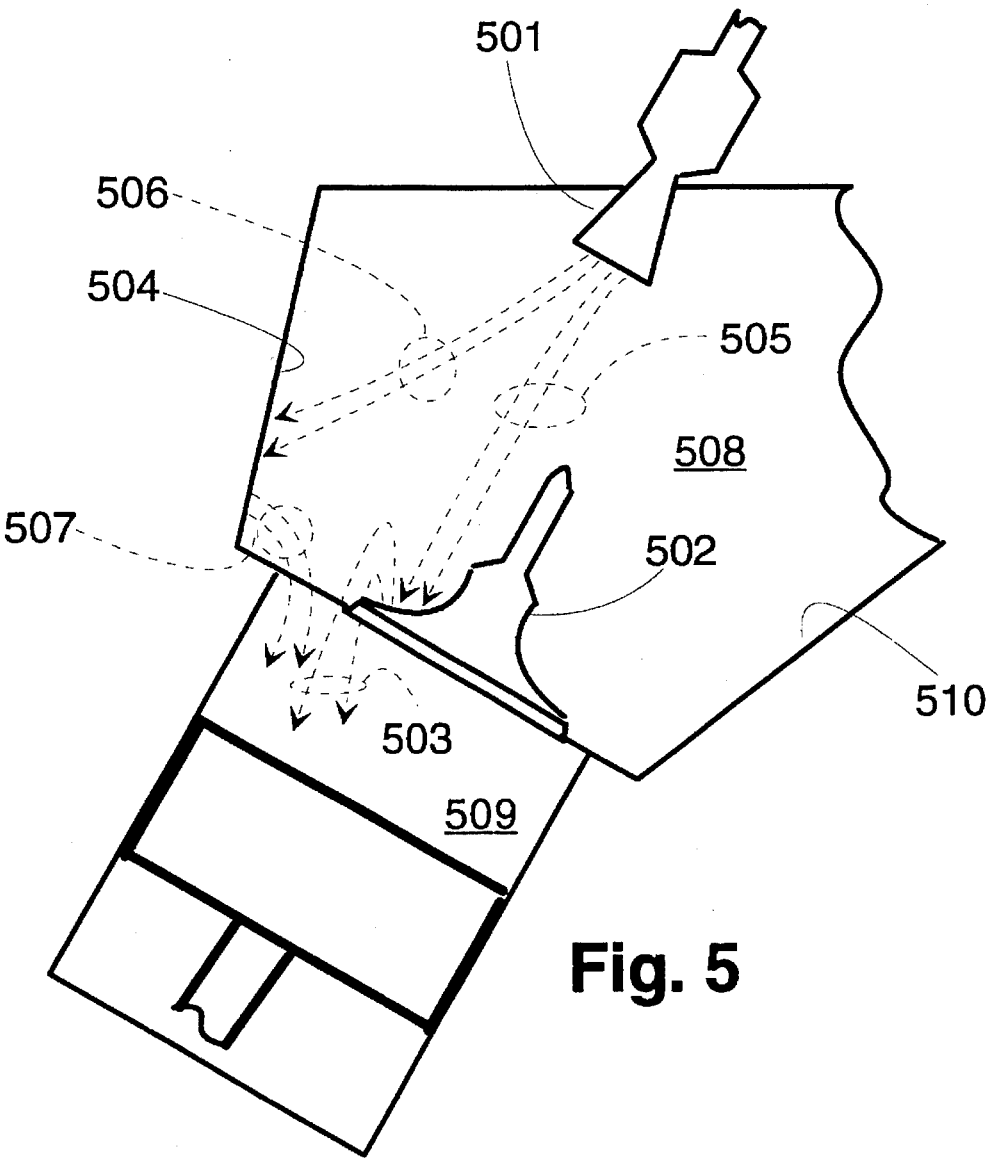
FIG. 5 is an illustration of a portion of the internal combustion engine of FIG. 1.

FIG. 5 of the drawings illustrates the physical quantities represented by first and second model values X and TAU. In FIG. 5 a fuel injector 501 of known type injects a quantity of fuel represented by lines 505 and 506. A portion 505 of the injected fuel directly impacts intake valve 502, a portion 503 of which enters combustion chamber 509 upon opening of valve 502. Another portion 506 of the injected fuel directly impacts an interior surface 504 of the induction system 508. Portion 506 and a portion of fuel remaining on the intake valve 502 form a fuel film or residue on the interior surface 504, which includes the surface of valve 502. A quantity 507 of the fuel film on wall 504 of the induction system leaves the interior surface 504 by vaporization or other means and enters combustion chamber 509 upon opening of valve 502, as does quantity 503. A fuel film also resides on other interior surfaces of the induction system 508 such as interior surface 510. First model value X is indicative of a portion of fuel impacted by the engine which directly impacts the internal surfaces of the induction system 508. Second model value TAU is indicative of a time constant corresponding to a rate at which fuel leaves the interior surfaces of said induction system by vaporization or other means.

With model values X and TAU as described above, the rate of fuel entering combustion chamber 509 may be represented by the following relationship:

$$ENGFUEL = (1 - X)\dot{m}_f + \frac{1}{\tau} m \quad (1)$$

where,

ENGFUEL is the net mass per second of fuel entering combustion chamber 509 from injector 501 and from film residue residing on the internal surfaces of the induction system;

X is as described above;

$\tau$ is equal to TAU as described above;

$\dot{m}_f$ is the rate of fuel mass injected by injector 501 in lbs/sec; and m is the mass of fuel residue on the interior surfaces of the induction system.

In an alternative embodiment, the value $\dot{m}_f$ may represent the mass of fuel per injection rather than the mass of fuel per unit time as described above. In such an embodiment, as will be readily apparent to those skilled in the art in view of the present disclosure, the value TAU will be indicative of a time constant corresponding to a rate at which fuel leaves the interior surfaces of said induction system by vaporization or other means and will be expressed in units of engine speed rather than time, as described in the present disclosure.

A rate of change of the fuel residue on the interior surfaces of the induction system with respect to time may be represented by the following relationship:

$$\frac{dm}{dt} = X\dot{m}_f - \frac{1}{\tau} m \quad (2)$$

where, dm/dt corresponds to a rate of change of the fuel residue on the interior surfaces of the induction system with respect to time; and X, $\tau$, $\dot{m}_f$ and m are as described above.

Figure 6:
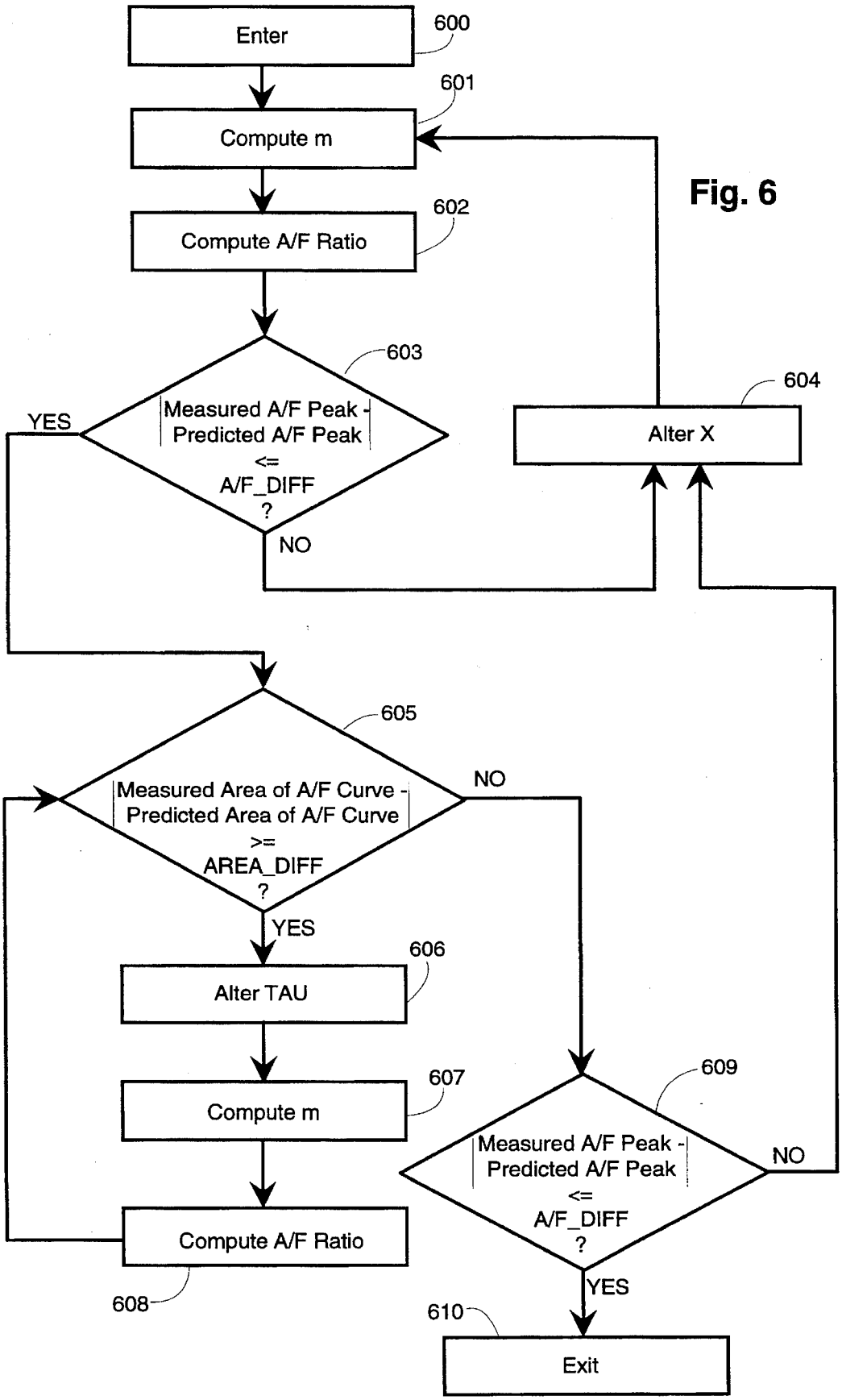
FIG. 6 is a flowchart showing the operation of a preferred embodiment of the invention.

A preferred embodiment advantageously utilizes the above two relationships to generate first and second model values X and TAU from an iterative automated process which utilizes the data contained in the data files generated from steps 202–208. Preferably two model values of X and TAU are generated; one set of model values corresponding to data indicative of engine operation while under acceleration and one set of model values corresponding to data indicative of engine operation while under deceleration. FIG. 6 is a flowchart showing the steps taken by a preferred embodiment to implement on a stored program computer, a model value generation routine which is used to generate first and second model values X and TAU by a substantially automated method. The model value generation routine is entered at 600 and at 601, using assumed initial values of X, TAU, and m. As explained above the value m is indicative of the mass of fuel residue on the interior surfaces of the induction system and is computed by integrating the relationship as shown above in equation (2). To compute an initial value for the fuel mass value m, in a preferred embodiment, model values X and TAU are assigned initial values. In a preferred embodiment for a five-liter engine, TAU is assigned an initial value of one second, and X is assigned an initial value of 0.3. As will be explained below, X and TAU are then iteratively altered to arrive at values which accurately predict the measured response to a transient condition.

As shown in FIG. 3, the cold start test mode under which the data files are generated is initiated by a stable throttle position held stable for a first time period. A preferred embodiment assumes that under stable operation, the rate of change of the fuel residue on the interior surfaces of the induction system with respect to time will remain constant. Consequently, the value dm/dt is set to zero in determining an initial value for the fuel mass value m as shown in equation (2). The value $\dot{m}_f$ which as explained above is the mass of fuel injected by injector 501 is a known quantity. With dm/dt set to zero, $\dot{m}_f$ being a known value, and X and TAU being estimated, an initial value for the fuel mass value m may be calculated. Once such a value is calculated, successive values of the fuel mass value m are calculated via a known numerical integration technique. Predicted air/fuel values are then calculated at 602 for the engine operation shown in FIG. 3 from the relationship shown in equation (1) and the measured value of mass air flow rate.

Figure 4:
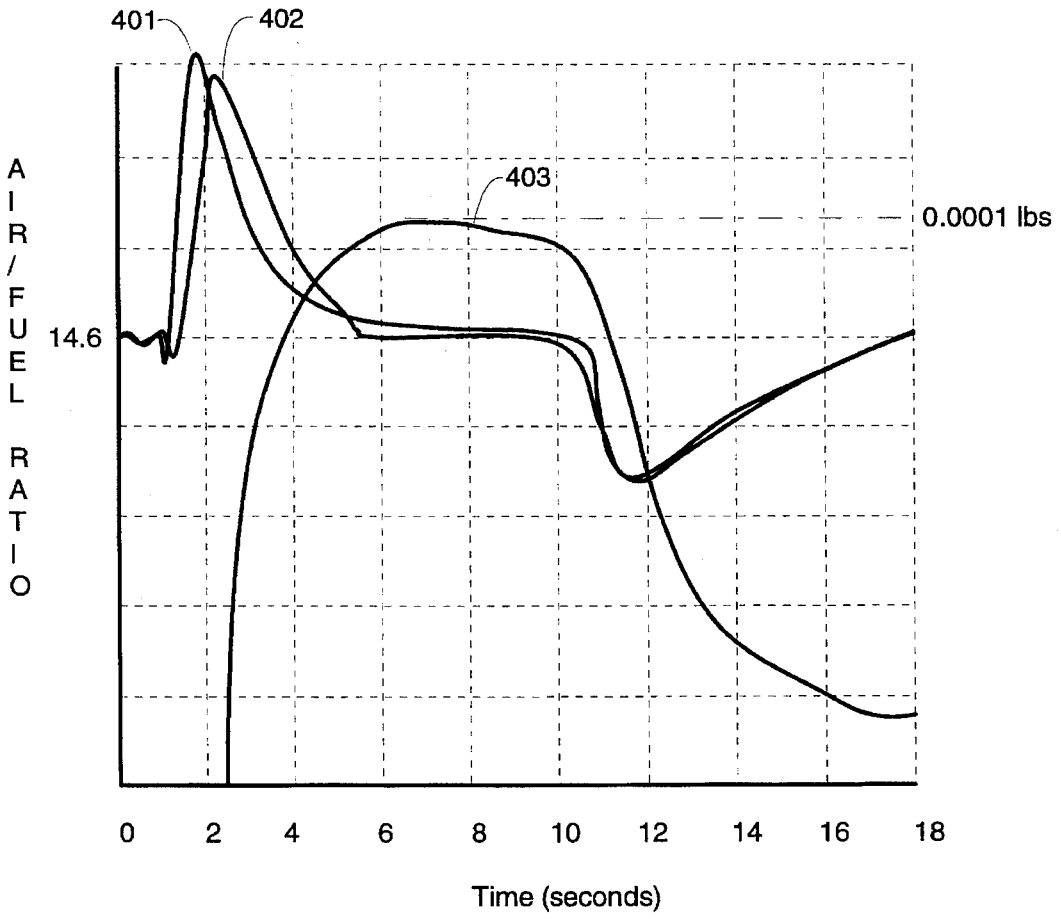
FIG. 4 is a graphical illustration showing predicted and actual values of certain characteristics of vehicle operation.

FIG. 4 of the drawings graphically illustrates measured and predicted air/fuel ratios of an engine versus time for an engine operated in a manner shown in FIG. 3 from points 300 to 307 for a particular engine operating temperature. Air/fuel ratio is represented along the vertical axis and time in seconds is represented along the horizontal axis. A measured air/fuel ratio versus time is shown at line 402 and a predicted air/fuel ratio versus time is shown at line 401. Line 401 is generated according to first and second model values X and TAU. An estimate of the mass of fuel on the interior surfaces 24 of the induction system 21 is shown at 403. As can be seen, the predicted and measured air/fuel ratios differ slightly with the predicted air/fuel ratio peaking at a higher level and declining faster than the actual air/fuel ratio.

At steps 603–609 model values X and TAU are iteratively altered and tested against the stored data until values which accurately predict the portion of fuel injected by the engine which directly impacts the induction system and the evaporative time constant corresponding to a vaporization rate of fuel on the interior surfaces of the induction system are obtained. At step 602, a peak predicted air/fuel value is generated by detecting the peak air/fuel ratio value exhibited by the engine during a particular transient state, as indicated in FIG. 4 at 401, and is compared at 603 against the peak measured air/fuel value. If the difference between such peak values is less than or equal to a predetermined air/fuel peak threshold value A/F_DIFF, then the value for X is determined to be appropriate. If the difference between the predicted and measured peak values is greater than A/F_DIFF then X is incrementally altered at 604 and the entire process starting at 602 is repeated. The steps 601 to 604 are repeated until a value for X is determined which meets the criteria set forth in step 603. X is preferably altered by taking the difference between the predicted peak air/fuel value and the measured air/fuel value (the difference being a negative value when predicted air/fuel is greater than measured air/fuel and the difference being a positive value when measured air/fuel is greater than predicted air/fuel) and multiplying it by a value of 0.0001 to generate an incremental alteration in X. By incrementally altering X a preferred embodiment allows a steady convergence upon an appropriate value.

Once a value for X which generates a predicted peak air/fuel ratio within a predetermined range about the measured peak air/fuel ratio is determined, a value of TAU is determined at steps 605 and 606. As explained above, TAU is indicative of a time constant corresponding to a rate at which fuel leaves the interior surfaces of said induction system by vaporization or other means. In the graph shown in FIG. 4, a larger value of TAU will result in slower changes in the air/fuel ratio and hence a larger area between the plotted curve and stoichiometry and a smaller value of TAU will result in more rapid changes in the air/fuel ratio and hence a smaller area between the plotted curve and stoichiometry. In a preferred embodiment both the measured and predicted air/fuel ratios are integrated with respect to time to determine respectively a measured air/fuel response and a predicted air/fuel response, each of the responses corresponding to the areas between each of the curves and stoichiometry. The difference between these values is then compared to a predetermined air/fuel response threshold value, AREA_DIFF to determine if TAU is set to an appropriate value. If the difference is greater than or equal to AREA_DIFF then TAU is incrementally altered at 606 and steps 605 to 608 are executed again. Steps 605 to 608 are repeated until TAU has been incrementally altered to a value which generates an air/fuel response which differs from the measured air/fuel response by an amount less than AREA_DIFF. If the difference is less than AREA_DIFF then at 609 the predicted peak value generated by the present values of X and TAU is compared against the measured peak value and if the difference is greater than A/F_DIFF then the incremental alterations of X at steps 601 to 604 are repeated, followed by repeat of steps 605 to 609. If at 609 the predicted peak value differs from the measured peak value by an amount less than A/F_DIFF then the routine is exited at 610.

As can be seen from FIG. 4 a time delay exists generally between the predicted air/fuel ratio and the measured air/fuel ratio. A substantial portion of this time delay is attributable to different methods utilized to generate the measured air/fuel response and the predicted air/fuel response. The predicted air/fuel response is generated. utilizing the measured mass air flow into the induction system while the measured air/fuel response is generated utilizing the measured exhaust gas composition as detected in the exhaust system of the engine under test. Consequently, the measured air/fuel response lags the predicted air/fuel response by an amount of time corresponding to the amount of time required for the air passing the air flow meter 17 to pass through the intake, compression, combustion and exhaust strokes of the engine and be propelled past the exhaust gas oxygen sensor 30. A preferred embodiment of the present invention computes the integral of the air/fuel ratio with respect to time for the measured air/fuel response and the predicted air/fuel response to determine an appropriate value for TAU rather than working with differences in the two curves at each value of time. This feature advantageously accounts for the time lag between the predicted and the measured response.

The compensation values for the EISF table are generated from the X and TAU values according to the following relationship:

$$EISF = \frac{X*\tau*\text{AIRMASS}}{A/F} \quad (3)$$

where,

EISF is an equilibrium intake surface fuel value as previously described,

X is as previously described, $\tau$ corresponds to TAU as previously described

AIRMASS is a value corresponding to a measured mass flow rate of air in lbs/sec into induction system 21, and A/F corresponds to a desired steady state air/fuel ratio at a particular engine operating temperature and load value. In a preferred embodiment, only first and second model values corresponding to data obtained while the engine is under acceleration are used in generating values for the EISF tables from the relationship shown in equation (3).

The compensation values for the EFTC tables are generated from the X and TAU values according to the following relationship:

$$EFTC=(1-X)*\tau \quad (4)$$

where,

EFTC is an effective fuel time constant as described above, and

X and TAU are as described above.

In a preferred embodiment, two sets of compensation values for the EFTC tables are generated: one set of compensation values corresponding to a time period over which a compensating mass of fuel is added or subtracted from a base fuel amount as generated by EEC 10 by known methods while the engine is under acceleration and a second set of compensation values corresponding to a time period over which a compensating mass of fuel is added or subtracted from a base fuel amount as generated by EEC 10 by known methods while the engine is under deceleration. First and second model values X and TAU corresponding to the appropriate transient condition, acceleration or deceleration, are utilized in equation (4) above to generate the corresponding values for the EFTC tables.

It is to be understood that the specific mechanisms and techniques which have been described are merely illustrative of one application of the principles of the invention. Various modifications may be made to the methods and apparatus described without departing from the true spirit and scope of the invention.

What is claimed is:

1. A data acquisition system which controls functions of an internal combustion engine, the engine including an induction system containing a plurality of interior surfaces, an intake valve within the induction system for controlling delivery of an air/fuel mixture into a combustion chamber, and injector means for injecting fuel through a portion of the induction system into the combustion chamber, the data acquistion system receiving signals indicative of operating parameters of the engine which has been exposed to an initial ambient temperature to set the engine to an initial start temperature substantially equal to the initial ambient temperature, the data acquisition system comprising, in combination:

means for operating the engine in a predetermined manner of engine operation which includes changing, over a first period of time, a throttle position of the engine from a first position to a second position, maintaining the second throttle position for a second period of time, changing, over a third period of time, the throttle position of the engine from the second position to the first position, and maintaining the first throttle position for a fourth period of time, said first, second, third and fourth periods of time being of a length appropriate to substantially isolate the effect of induction system wetting on said fuel delay, means, responsive to a signal indicative of the mass flow rate of air into the induction system, for generating a plurality of air flow values indicative of the mass flow rate of air into the engine, means, responsive to a signal indicative of engine coolant temperature, for generating a plurality of engine coolant temperature values;

means, responsive to a signal indicative of exhaust gas composition produced by the engine, for generating a plurality of exhaust gas values, each of which is indicative of the composition of exhaust gas produced by the engine at a different point in time;

means for storing the air flow values, engine coolant temperature values and the exhaust gas values in a data storage means;

means for generating as a function of the air flow values, engine coolant temperature values and the exhaust gas values a first set of model values each value being indicative of a portion of fuel injected by the engine which directly impacts interior surfaces of the induction system at a particular engine operating temperature;

means for generating as a function of the air flow values, engine coolant temperature values and the exhaust gas values a second set of model values each of which is indicative of a time constant corresponding to a rate at which fuel leaves the interior surfaces of the induction system at a particular engine operating temperature; and means for generating a set of compensation values as a function of the first and the second model values.

2. The data acquisition system as set forth in claim 1 wherein the means for generating a set of compensation values comprises a first means for generating a first set of compensation values and a second means for generating a second set of compensation values, each value of the first set of compensation values corresponding to a mass of fuel residue residing on the interior surfaces of the induction system when the engine is at a particular engine operating temperature and air flow rate, each value of the second set of compensation values corresponding to an effective fuel time constant indicative of a time period over which a compensating mass of fuel is added or subtracted by said engine controller to a base fuel value generated by said engine controller while the engine is under a transient state.

3. A method for generating compensation values for use in an electronic engine controller to compensate for fuel delay during transient operation of an internal combustion engine, the engine including an induction system comprised of interior surfaces, the method comprising the steps of:

(a) exposing the engine to an ambient temperature to set the engine to an initial engine start temperature;

(b) starting the engine and operating the engine in a predetermined manner of engine operation which comprises at least one transient engine operating conditions;

(c) monitoring the mass flow rate of air into the induction system during the engine operation to generate a plurality of air flow values;

(d) monitoring the temperature of engine coolant within the engine during the engine operation to generate a plurality of engine coolant temperature values;

(e) monitoring the composition of exhaust gas produced by the engine to generate a plurality of exhaust gas composition values each of which is indicative of an air/fuel ratio ignited by said engine to produce said exhaust gas;

(f) storing the air flow values, engine coolant temperature values and the exhaust gas composition values to a data file;

(g) repeating steps (a) through (f) for a plurality of ambient temperatures to develop a plurality of data files, each data file containing air flow values, engine coolant temperature values and exhaust gas composition values corresponding to engine operation from a particular initial engine start temperature;

(h) generating via a substantially automated method, a first set and a second set of model values as a function of the values contained in the plurality of data files, each value of the first set of model values being indicative of a portion of fuel injected by the engine which directly impacts the interior surfaces of the induction system at a particular engine operating temperature and each value of the second set of model values being indicative of a time constant corresponding to a rate at which fuel leaves the interior surfaces of the induction system by vaporization or other means; and (i) generating via a substantially automated method, the compensation values as a function of the first and the second model values, the compensation values comprising a first set and a second set of compensation values, each value of the first set of compensation values corresponding to a mass of fuel residue residing on the interior surfaces of the induction system when the engine is at a particular engine operating temperature and air flow rate, each value of the second set of compensation values corresponding to an effective fuel time constant indicative of a time period over which a compensating mass of fuel is added or subtracted by said engine controller to a base fuel value generated by said engine controller whle the engine is under a transient state.

4. The method as set forth in claim 3 wherein the second set of compensation values comprise a set of acceleration effective fuel time constant values and a set of deceleration effective fuel time constant values, the acceleration effective fuel time constant values indicative of a time period over which a compensating mass of fuel is added or subtracted by said engine controller to a base fuel value generated by said engine controller while the engine is under acceleration, and the deceleration effective fuel time constant values corresponding to an effective fuel time constant indicative of a time period over which a compensating mass of fuel is added or subtracted by said engine controller to a base fuel value generated by said engine controller while the engine is under deceleration.

5. The method as set forth in claim 4 wherein the first set of model values comprises a set of acceleration model values indicative of a portion of fuel injected by the engine which directly impacts the interior surfaces of the induction system at a particular engine operating temperature during acceleration and wherein the first set of model values further comprises a set of deceleration model values indicative of a portion of fuel injected by the engine which directly impacts the interior surfaces of the induction system at a particular engine operating temperature during deceleration.

6. The method as set forth in claim 5 comprising an additional step of generating a plurality of load values corresponding to said stored air flow values and wherein the first set of compensation values are generated according to the following relationship:

$$EISF=(X*TAU*AIRMASS)/A/F$$

where,

EISF is a value from the first set of compensation values corresponding to a particular engine operating temperature and load value;

X corresponds to a value from the first set of model values and is indicative of a portion of fuel injected by the engine which directly impacts the induction system at the particular engine operating temperature, TAU corresponds to a value from the second set of model values and is indicative of a time constant corresponding to a rate of fuel leaving the walls of the induction system for a given mass of fuel on the interior surfaces of said induction system at the particular engine operating temperature;

AIRMASS is a value corresponding to a measured mass flow rate of air in lbs/sec into the induction system, and A/F corresponds to a desired steady state air/fuel ratio at a particular engine operating temperature and load value.

7. The method as set forth in claim 6 wherein the acceleration effective fuel time constant values are generated according to the following relationship:

$$EFTCA=(1-X)*TAU$$

where,

EFTCA is the acceleration effective fuel time constant value for a particular engine operating temperature and engine load, X corresponds to a value from the first set of acceleration model values and is indicative of a portion of fuel injected by the engine which directly impacts the induction system at the particular engine operating temperature, and TAU is a value from said set of acceleration model values corresponding to the particular engine operating temperature.

8. The method as set forth in claim 7 wherein the deceleration effective fuel time constant values are generated according to the following relationship:

$$EFTCD=(1-X)*TAU$$

where,

EFTCD is the deceleration effective fuel time constant value for a particular engine operating temperature and engine load, X corresponds to a value from the first set of deceleration model values and is indicative of a portion of fuel injected by the engine which directly impacts the induction system at the particular engine operating temperature, and TAU is a value from said set of deceleration model values corresponding to the particular engine operating temperature.

9. The method as set forth in claim 7 wherein the predetermined manner of engine operation comprises the steps of:

(i) changing, over a first period of time, a throttle position of the engine from a first position to a second position;

(ii) maintaining the second throttle position for a second period of time;

(iii) changing, over a third period of time, the throttle position of the engine from the second position to the first position;

(iv) maintaining the first throttle position for a fourth period of time, said first, second, third and fourth periods of time being of a length appropriate to substantially isolate the effect of induction system wetting on said fuel delay;

(v) repeating steps (i) through (iv) until the engine coolant reaches a predetermined temperature indicative of a steady state engine operating temperature.

10. A method for generating compensation values for use in an electronic engine controller to compensate for fuel delay during transient operation of an internal combustion engine, the engine including an induction system comprised of interior surfaces, the method comprising the steps of:

(a) exposing the engine to an ambient temperature to set the engine to an initial engine start temperature;

(b) starting the engine and operating the engine in a predetermined manner of engine operation which comprises at least one transient engine operating conditions;

(c) monitoring the mass flow rate of air into the induction system during the engine operation to generate a plurality of air flow values;

(d) monitoring the temperature of engine coolant within the engine during the engine operation to generate a plurality of engine coolant temperature values;

(e) monitoring the composition of exhaust gas produced by the engine to generate a plurality of exhaust gas composition values each of which is indicative of an air/fuel ratio ignited by said engine to produce said exhaust gas;

(f) storing the air flow values, engine coolant temperature values and the exhaust gas composition values to a data file;

(g) repeating steps (a) through (f) for a plurality of ambient temperatures to develop a plurality of data files, each data file containing air flow values, engine coolant temperature values and exhaust gas composition values corresponding to engine operation from a particular initial engine start temperature;

(h) generating via a substantially automated method, a first set and a second set of model values as a function of the values contained in the plurality of data files, each value of the first set of model values being indicative of a portion of fuel injected by the engine which directly impacts the interior surfaces of the induction system at a particular engine operating temperature and each value of the second set of model values being indicative of a time constant corresponding to a rate at which fuel leaves the interior surfaces of the induction system by vaporization or other means; and (i) generating the compensation values as a function of the first and the second model values.

11. The method as set forth claim 10 wherein the predetermined manner of engine operation comprises the step of:

(i) changing, over a first period of time, a throttle position of the engine from a first position to a second position;

(ii) maintaining the second throttle position for a second period of time;

(iii) changing, over a third period of time, the throttle position of the engine from the second position to the first position;

(iv) maintaining the first throttle position for a fourth period of time, said first, second, third and fourth periods of time being of a length appropriate to substantially isolate the effect of induction system wetting on said fuel delay;

(v) repeating steps (i) through (iv) until the engine coolant reaches a predetermined temperature indicative of a steady state engine operating temperature.

12. The method as set forth in claim 10 wherein the second set of model values comprises a set of acceleration model values corresponding to a rate at which fuel leaves the interior surfaces of the induction system by vaporization or other means while the engine is under acceleration, and wherein the second set of model values further comprises a set of deceleration model values corresponding to a rate at which fuel leaves the interior surfaces of the induction system by vaporization or other means while the engine is under deceleration.

13. The method as set forth in claim 12 wherein the first set of model values comprises a set of acceleration model values indicative of a portion of fuel injected by the engine which directly impacts the interior surfaces of the induction system at a particular engine operating temperature during acceleration and wherein the first set of model values further comprises a set of deceleration model values indicative of a portion of fuel injected by the engine which directly impacts the interior surfaces of the induction system at a particular engine operating temperature during deceleration.

14. The method as set forth in claim 13 wherein the compensation values comprise a first set and a second set of compensation values, each value of the first set of compensation values corresponding to a mass of fuel residue residing on the interior surfaces of the induction system when the engine is at a particular engine operating temperature and air flow rate, each value of the second set of compensation values corresponding to an effective fuel time constant indicative of a time period over which a compensating mass of fuel is added or subtracted by said engine controller to a base fuel value generated by said engine controller while the engine is under a transient state.

15. The method as set forth in claim 14 wherein the predetermined manner of engine operation comprises the steps of:

(i) changing, over a first period of time, a throttle position of the engine from a first position to a second position;

(ii) maintaining the second throttle position for a second period of time;

(iii) changing, over a third period of time, the throttle position of the engine from the second position to the first position;

(iv) maintaining the first throttle position for a fourth period of time, said first, second, third and fourth periods of time being of a length appropriate to determine the effect of induction system wetting effects on said fuel delay;

(v) repeating steps (i) through (iv) until the engine coolant reaches a predetermined temperature indicative of a steady state engine operating temperature.

16. The method as set forth in claim 15 wherein the second set of compensation values comprise a set of acceleration effective fuel time constant values and a set of deceleration effective fuel time constant values, each of the acceleration effective fuel time constant values indicative of a time period over which a compensating mass of fuel is added or subtracted by said engine controller to said base fuel value generated by said engine controller while the engine is under acceleration and at a particular engine coolant temperature and load and each of the deceleration effective fuel time constant values indicative of a time period over which a compensating mass of fuel is added or subtracted by said engine controller to said base fuel value generated by said engine controller while the engine is under deceleration and at a particular engine coolant temperature and load.

17. The method as set forth in claim 16 comprising an additional step of generating a plurality of load values corresponding to said stored air flow values and wherein the first set of compensation values are generated according to the following relationship:

$$EISF=(X*TAU*AIRMASS)/A/F$$

where,

EISF is a value from the first set of compensation values corresponding to a particular engine operating temperature and load value;

X corresponds to a value from the first set of model values and is indicative of a portion of fuel injected by the engine which directly impacts the induction system at the particular engine operating temperature, TAU corresponds to a value from the second set of model values;

AIRMASS is a value corresponding to a measured mass flow rate of air in lbs/sec into the induction system, and A/F corresponds to a desired steady state air/fuel ratio at a particular engine operating temperature and load value.

18. The method as set forth in claim 17 wherein the acceleration effective fuel time constant values are generated according to the following relationship:

$$EFTCA=(1-X)*TAU$$

where,

EFTCA is the acceleration effective fuel time constant value for a particular engine operating temperature and engine load, X corresponds to a value from the first set of acceleration model values and is indicative of a portion of fuel injected by the engine which directly impacts the induction system at the particular engine operating temperature, and TAU is a value from said set of acceleration model values corresponding to the particular engine operating temperature.

19. The method as set forth in claim 18 wherein the deceleration effective fuel time constant values are generated according to the following relationship:

$$EFTCD=(1-X)*TAU$$

where,

EFTCD is the deceleration effective fuel time constant value for a particular engine operating temperature and engine load, X corresponds to a value from the first set of deceleration model values and is indicative of a portion of fuel injected by the engine which directly impacts the induction system at the particular engine operating temperature, and TAU is a value from said set of deceleration model values corresponding to the particular engine operating temperature.

20. The method as set forth in claim 19 wherein each of the values of the second set of model values is generated by the steps of:

(i) generating an initial value for said first set and said second set of model values for a particular engine operating temperature;

(ii) generating a plurality of air/fuel ration values from said measured exhaust gas composition values, (iii) integrating said plurality of air/fuel ratio values over time to generate a time dependent measured air/fuel response;

(iv) generating a time dependent predicted air/fuel response from said generated value of said first set of model values and from said value for said second set of model values;

(v) comparing said predicted air/fuel response to said measured air/fuel response to generate an air/fuel response difference value;

(vi) comparing said air/fuel response difference value to a predetermined air/fuel response threshold value;

(vii) altering said value for said second set of model values and repeating steps (ii) through (vi) if said air/fuel response difference value is greater than or equal to said predetermined air/fuel response threshold value, and modifying said value from said first set of model values and repeating steps (i) through (vii) if said air/fuel response difference value is less than said predetermined air/fuel response value, to generate a plurality of values for said first set of model values, each of said values corresponding to a particular engine operating temperature.

* * * * *